US005316689A

United States Patent [19]

Farrell

[11] Patent Number: 5,316,689

[45] Date of Patent: May 31, 1994

[54] TOY SOAP CONTAINING COMPRESSED SPONGE WHICH POPS OUT DURING USE

[76] Inventor: Dennis A. Farrell, 33 Hollow Oak Rd., Chappaqua, N.Y. 10514

[21] Appl. No.: 687,275

[22] Filed: Apr. 19, 1991

[51] Int. Cl.[5] ..... C11D 17/04

[52] U.S. Cl. ..... 252/92; 252/90; 252/134; 252/174; 252/DIG. 16; 446/153

[58] Field of Search ..... 252/90, 92, 134, 174; 15/244.4, 104.94; 446/153

[56] References Cited

U.S. PATENT DOCUMENTS

| | | | |
|---|---|---|---|
| 821,245 | 5/1906 | Hutchinson | 252/92 |
| 2,677,913 | 5/1954 | Swartz | 252/92 |
| 3,359,206 | 5/1964 | Cratsa | 252/92 |
| 3,403,106 | 9/1968 | Story et al. | 252/92 |
| 4,308,157 | 12/1981 | DiGiovanna | 252/92 |
| 4,881,915 | 11/1989 | Liaw | 446/14 |

FOREIGN PATENT DOCUMENTS

| | | | |
|---|---|---|---|
| 2910348 | 9/1980 | Fed. Rep. of Germany | 252/92 |
| 3529305 | 2/1987 | Fed. Rep. of Germany | 252/92 |
| 2648824 | 12/1990 | France | 252/92 |
| 2028299 | 1/1990 | Japan | 252/92 |
| 0602915 | 8/1978 | Switzerland | 252/92 |
| 881767 | 11/1961 | United Kingdom | 252/92 |

*Primary Examiner*—Christine Skane
*Assistant Examiner*—Bradley A. Swope
*Attorney, Agent, or Firm*—Carl C. Kling

[57] ABSTRACT

A novelty soap bar surrounds a supercompressed sponge novelty item which pops out when significant use of the soap provides a path for water entry which triggers a surprise expansion of the supercompressed sponge novelty. The supercompressed sponge novelty item, or plurality of novelty items positioned together or separately, pops out when the enclosing soap shell becomes sufficiently thin to permit moisture to enter and expand the supercompressed sponge novelty item. The supercompressed sponge novelty item is encapsulated in a slow-soluble or non-soluble soft easily-abradable encapsulent to prevent moisture from expanding the novelty item during manufacture or shelf life.

6 Claims, 1 Drawing Sheet

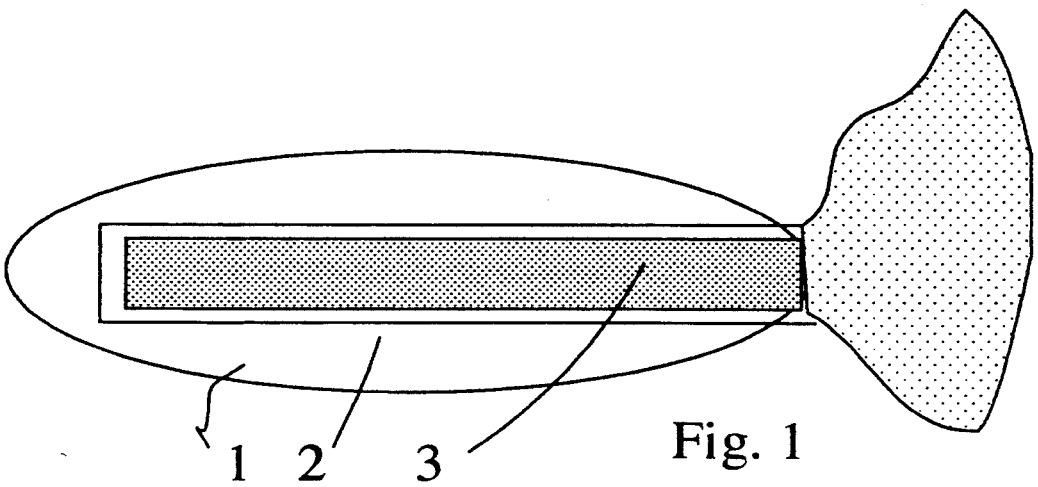
Fig. 1
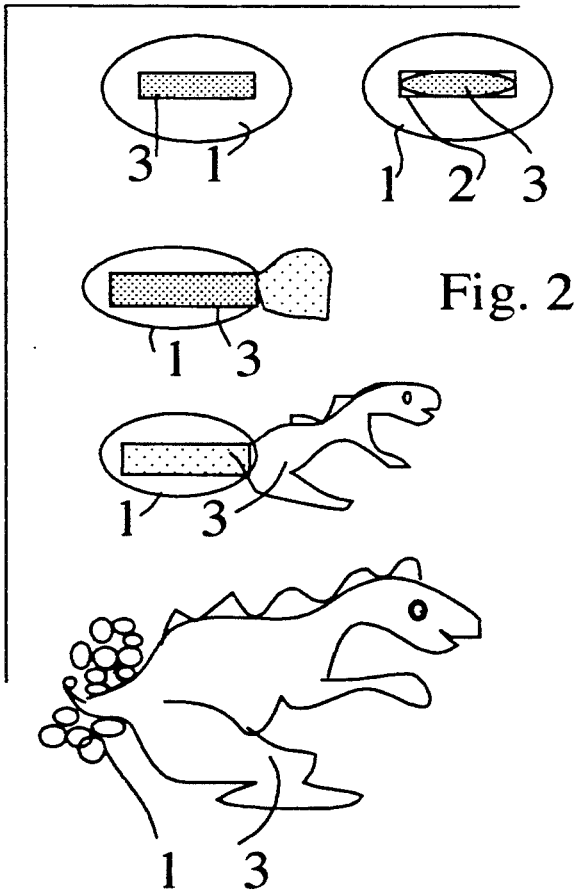
Fig. 2
Fig. 3
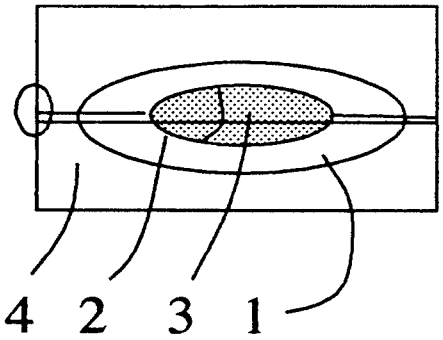

TOY SOAP CONTAINING COMPRESSED SPONGE WHICH POPS OUT DURING USE

BACKGROUND OF THE INVENTION

1. Field of the Invention

This invention relates to novelty soap, and particularly to a novelty soap bar surrounding a supercompressed sponge novelty item which pops out when significant use of the soap provides a path for water entry which triggers a surprise expansion of the supercompressed sponge novelty.

2. Description of Related Art

Supercompressed sponges are known novelty items. Compressed sponges with impregnation of soap are known. Novelty soap items such as soap in the shape of dinosaurs are known. Jack-in-the-box toys are well known. Hidden prize identifications such as lottery prize identifications are known in secure locations such as bottle cap liners. Toy-in-box prizes are known in such items as CRACKER JACK caramel popcorn.

There has, however, been no previous showing of a novelty soap item with an internally captured supercompressed sponge novelty which pops up like a jack-in-the-box as the soap covering is removed by use.

SUMMARY OF THE INVENTION

It is the object of the invention to provide a novelty soap item with an internal pop-out novelty as a reward.

A feature of the invention is a supercompressed sponge toy captured within the soap so as to pop out unexpectedly in use.

An advantage of the invention is its elegant simplicity, its total lack of moving parts.

Another advantage is its relative ease of manufacture including its packaging, the novelty item of supercompressed sponge being packaged within the soap bar.

Another advantage of the invention is its appeal to the young child who may not appreciate ordinary soap but may thoroughly enjoy washing with the sponge-toy soap—in the expectation of a dinosaur toy popping out.

Another advantage of the invention is its hidden-prize security, which permits it to be used for hidden-prize promotions.

Other objects, features and advantages of the invention will be apparent from the following specification and from the annexed drawings and claims.

BRIEF DESCRIPTION OF THE DRAWINGS

FIG. 1 is an semidiagrammatic view of the novelty soap as the supercompressed sponge novelty item (dinosaur toy shown) is in the act of popping out of the soap shell.

FIG. 2 is a composite sequence depiction of a soap bar with the included supercompressed sponge novelty item (either encapsulated with a moisture barrier or not) and in this figure shown as a dinosaur.

FIG. 3 is a view of a half-filled soap mold, with the supercompressed sponge novelty item in place; the mold is ready for final filling with soap.

DETAILED DESCRIPTION OF THE PREFERRED EMBODIMENT

FIG. 1 shows the soap at the instant at which soap shell 1 has worn down sufficiently to let water penetrate through the slow-soluble encapsulant 2 and expand the novelty item 3 of previously supercompressed sponge. The sponge-toy shown in FIG. 1 is a dinosaur.

FIG. 2 shows the sequence as the complete novelty soap bar 1 is shown prior to use, the internal supercompressed sponge dinosaur 3 and slow-soluble encapsulant 2 resting in place internally. Two alternatives, unencapsulated and encapsulated, are shown at the beginning.

As the soap wears down in use, the time comes when the soap covering has worn away sufficiently to permit water to penetrate any encapsulant 2 and start to swell the sponge-toy 3.

Further wetting causes the sponge-toy 3 to swell and emerge from the soap bar 1 as a forming dinosaur.

Finally, the sponge-toy 3 has emerged completely, and is now fully formed, shown as a dinosaur in FIG. 2.

FIG. 1 shows the sponge-toy soap at the moment of expansion.

FIG. 2 shows the sponge-toy soap at an intermediate time, at the instant of emergence, partially formed but still held by the soap, and fully formed.

FIG. 3 shows the soap bar as it is being manufactured. The soap mold 4 is half full of soap, and the dinosaur 3 of supercompressed sponge material encapsulated in slow-soluble encapsulant 2 is in place. The novelty item of supercompressed sponge (shown in FIG. 2 as a dinosaur) is preferably cool, even refrigerated, to retard passage of moisture through to the novelty item during manufacture. Once the encapsulated novelty item is securely in place, the top half of the soap mold may be put in place and the soap filling completed. Where appropriate, the molded bar of soap may be press-molded to harden the soap as a complete bar and to form a design or trade name. Encapsulant 2 may be eliminated if the soap is sufficiently moisture-free during manufacture and shelf life.

The novelty item need not be precisely at the centroid of the bar. If positioned close to the outside of the soap shell, the dinosaur may hatch early as a special surprise. Multiple novelty items of supercompressed sponge may be included, to "hatch" together or separately depending upon whether positioned together or apart.

The soap preferably is of facial soap quality and mildness. The slow-soluble encapsulant is preferably gelatin encapsulation similar in composition to that used for medication capsules, but may be any of a number of available water-soluble or semi-soluble dip or spray encapsulants. Where the soap composition is sufficiently dry during molding, the supercompressed sponge might simply be used without encapsulation, but we prefer to use at least a spray encapsulant such as PAM or KRYLON. The encapsulant need not be water-soluble at all, nor even be soluble in soapy water, so long as it retards the moisture sufficiently to permit the supercompressed sponge to stay supercompressed during the filling process, shelf lift and beginning usage. The encapsulant, of course, must be benign chemically, so as not to irritate the skin of the user of the soap, and must be sufficiently thin or sufficiently soft to abrade away during use without cutting or otherwise injuring the user.

While the invention has been shown preferably in the form of a novelty soap item, with a supercompressed sponge-toy, it will be clear to those skilled in the art that the modifications described as alternatives, plus other alternatives, may be pursued without departing from the spirit and scope of the invention, as defined in the following claims:

I claim:

1. A novelty soap comprising a soap shell enclosing a supercompressed sponge novelty item which pops out when said soap shell has worn away sufficiently to allow water to dampen said sponge.

2. A novelty soap according to claim 1, in which the supercompressed sponge novelty item is encapsulated in a soft slow-soluble encapsulant.

3. A novelty soap according to claim 1, in which the supercompressed sponge novelty item is positioned away from the centroid of the soap.

4. A novelty soap according to claim 1, in which said supercompressed sponge novelty includes a plurality of pieces positioned together.

5. A novelty soap according to claim 1, in which said supercompressed sponge novelty includes a plurality of pieces positioned separately.

6. A novelty soap according to claim 2, in which said soft slow-soluble encapsulant is soft, poorly soluble in water, and sufficiently thin to abrade away during ordinary usage of the soap.

* * * * *